US011498191B2

(12) United States Patent
Chiang

(10) Patent No.: US 11,498,191 B2
(45) Date of Patent: Nov. 15, 2022

(54) QUICK-RELEASE TOOL CONNECTION ROD

(71) Applicant: SHIN YING ENTPR CO., LTD., Taichung (TW)

(72) Inventor: Wen-Hung Chiang, Taichung (TW)

(73) Assignee: SHIN YING ENTPR CO., LTD., Taichung (TW)

( * ) Notice: Subject to any disclaimer, the term of this patent is extended or adjusted under 35 U.S.C. 154(b) by 177 days.

(21) Appl. No.: 17/022,926

(22) Filed: Sep. 16, 2020

(65) Prior Publication Data

US 2022/0080565 A1 Mar. 17, 2022

(51) Int. Cl.
*B25B 23/00* (2006.01)
*B25B 21/00* (2006.01)

(52) U.S. Cl.
CPC ..... *B25B 23/0035* (2013.01); *B25B 21/00* (2013.01)

(58) Field of Classification Search
CPC ..... B25B 23/0035; B25B 21/00; B25B 23/12; B25B 15/001; B23B 31/22; B23B 31/28
USPC ..... 81/438
See application file for complete search history.

(56) References Cited

U.S. PATENT DOCUMENTS 6,345,560 B1 * 2/2002 Strauch ..... B25B 15/001 81/477
8,479,616 B2 * 7/2013 Tsai ..... B25B 13/06 81/448
2003/0025281 A1 * 2/2003 Higasi ..... B25D 17/088 279/75

* cited by examiner

*Primary Examiner* — Joseph J Hail
*Assistant Examiner* — Caleb Andrew Holizna
(74) *Attorney, Agent, or Firm* — Muncy, Geissler, Olds & Lowe, P.C.

(57) ABSTRACT

A quick-release tool connection rod is provided, including a main member, a sleeve and at least one locking mechanism. The sleeve is movably on the main member. The at least one locking mechanism includes a skew guide face, an elongate hole and a locking ball, the skew guide face is disposed on the sleeve, the elongate hole is disposed on the main member, and the locking ball is disposed in the elongate hole.

7 Claims, 10 Drawing Sheets

QUICK-RELEASE TOOL CONNECTION ROD

BACKGROUND OF THE INVENTION

Field of the Invention

The present invention relates to a quick-release tool connection rod.

Description of the Prior Art

Generally, when people use a screw driver to screw or disassemble an object, they may often unable to drive the screw to rotate with just one hand. If this happened, they need to use a power rotation tool, a tool connection rod and a screw driver to lessen the burden of a worker and increase the operation speed.

However, on the market, the tool connection rods manufactured by a company only support the screw drivers manufactured by that specific company, a common tool connection rod cannot cooperate with the screw drivers in different sizes, and the existing tool connection rods cannot quickly release the screw drivers, so it is inconvenient and time-consuming in the operation process.

The present invention has arisen to mitigate and/or obviate the afore-described disadvantages.

SUMMARY OF THE INVENTION

The major object of the present invention is to provide a quick-release tool connection rod which can be assembled to various types of screwdriver bits, and a quick-release feature allows a user to operate the quick-release tool connection rod easily.

To achieve the above and other objects, a quick-release tool connection rod is provided, including a main member, a sleeve and at least one locking mechanism. The main member includes a connecting rod and a working socket which are connected to each other, the connecting rod is configured to be assembled to a power tool, the working socket includes an interior space and an insertion opening which communicate with each other, and the insertion opening is configured for a driving member to be inserted into the interior space. The sleeve is movably sleeved on the working socket, the sleeve includes an interior wall face and an exterior wall face, the interior wall face faces the main member, and the exterior wall face is opposite to the main member. Each said locking mechanism includes a skew guide face, an elongate hole and a locking ball, the elongate hole is disposed through the working socket, the elongate hole defines an open direction and an extension direction which are perpendicular to each other, the skew guide face is recessed on the interior wall face and faces the elongate hole, the skew guide face and the working socket define a first receiving space, the first receiving space communicates with the interior space through the elongate hole, the first receiving space defines a tightening end and a loosening end on the extension direction, the skew guide face is gradually distant radially from the working socket in a direction from the tightening end toward the loosening end, and the locking ball moves along the extension direction and is movably positioned within the elongate hole along the open direction.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
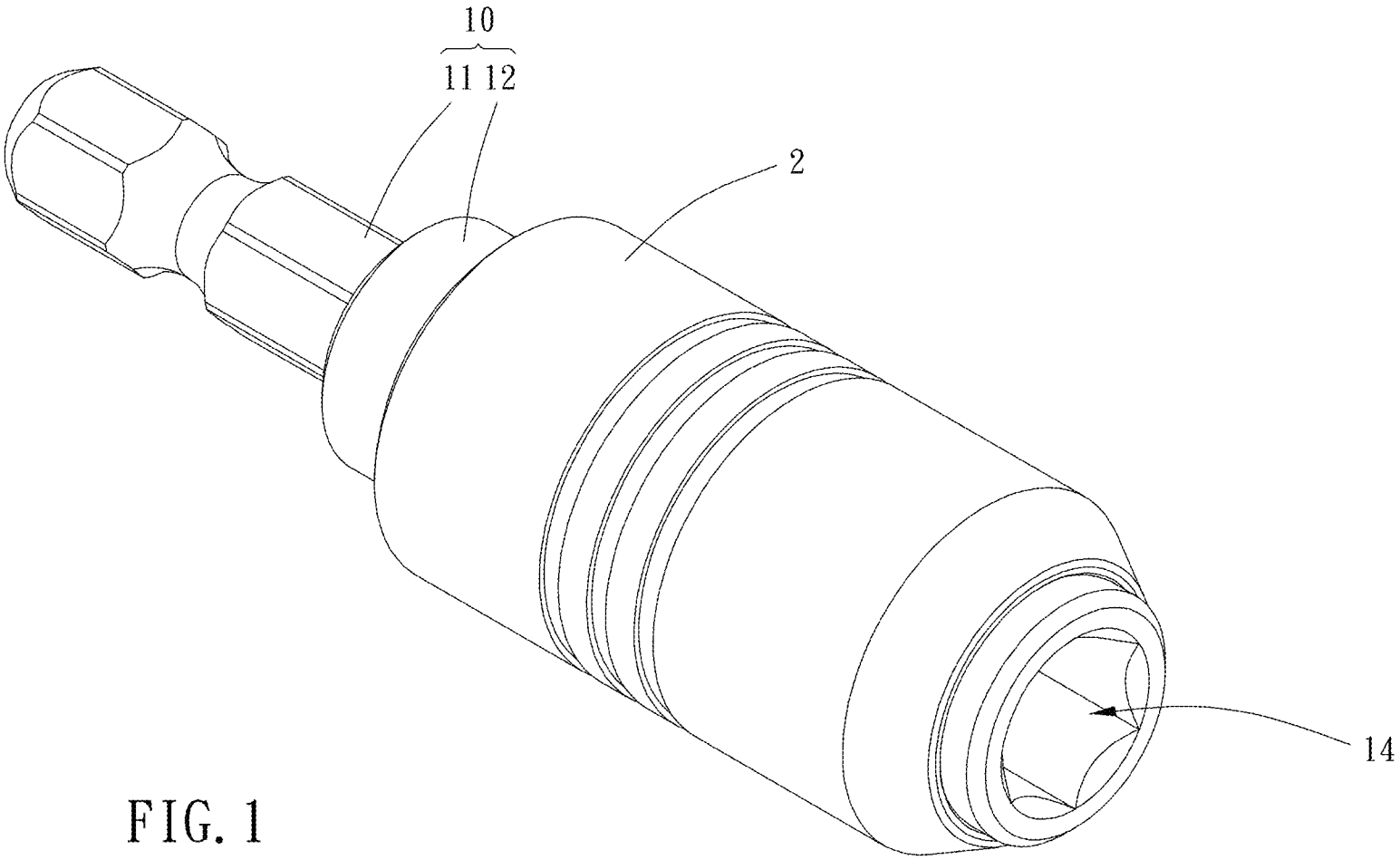
FIG. 1 is a stereogram of an embodiment of the present invention.
Figure 2:
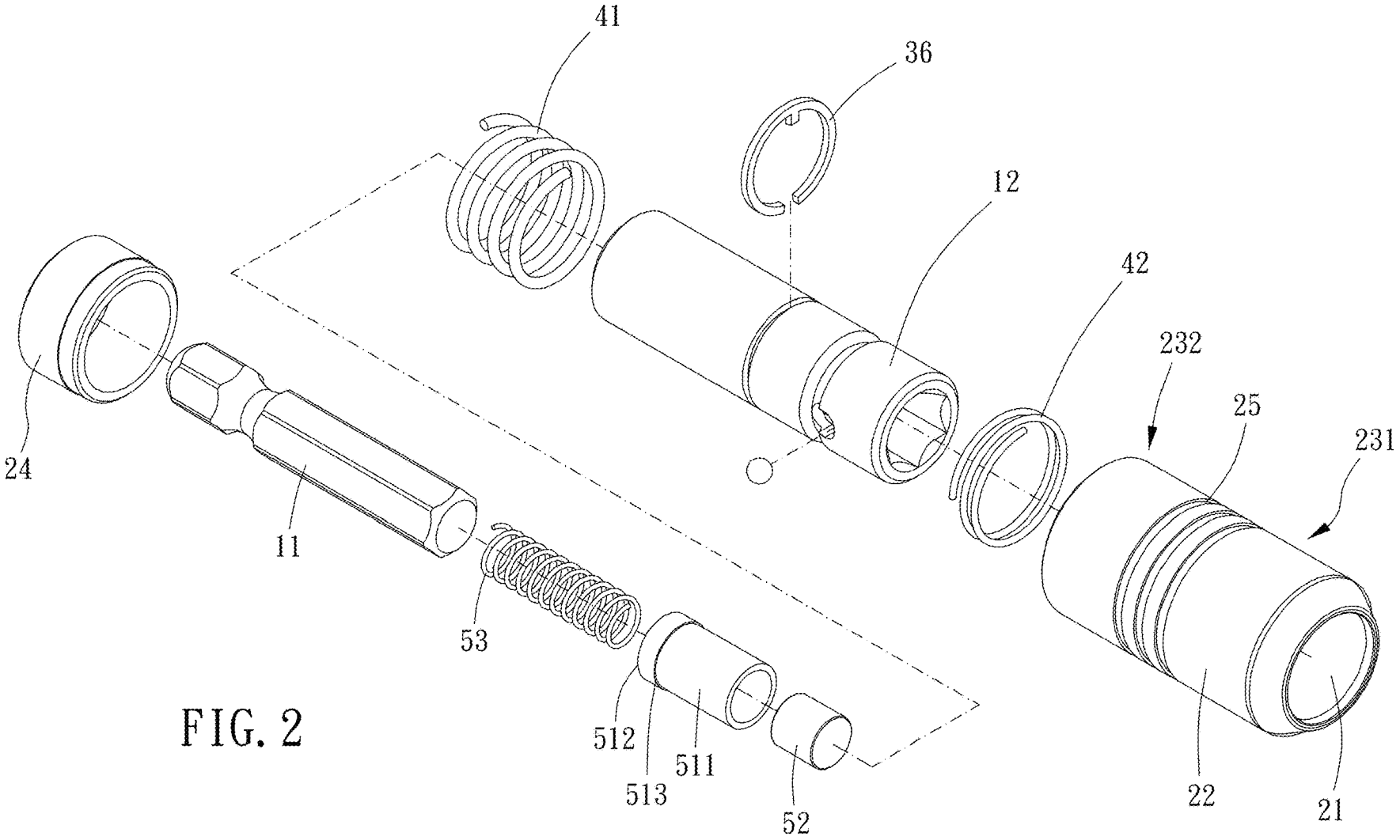
FIG. 2 is a breakdown view of FIG. 1.
Figure 3:
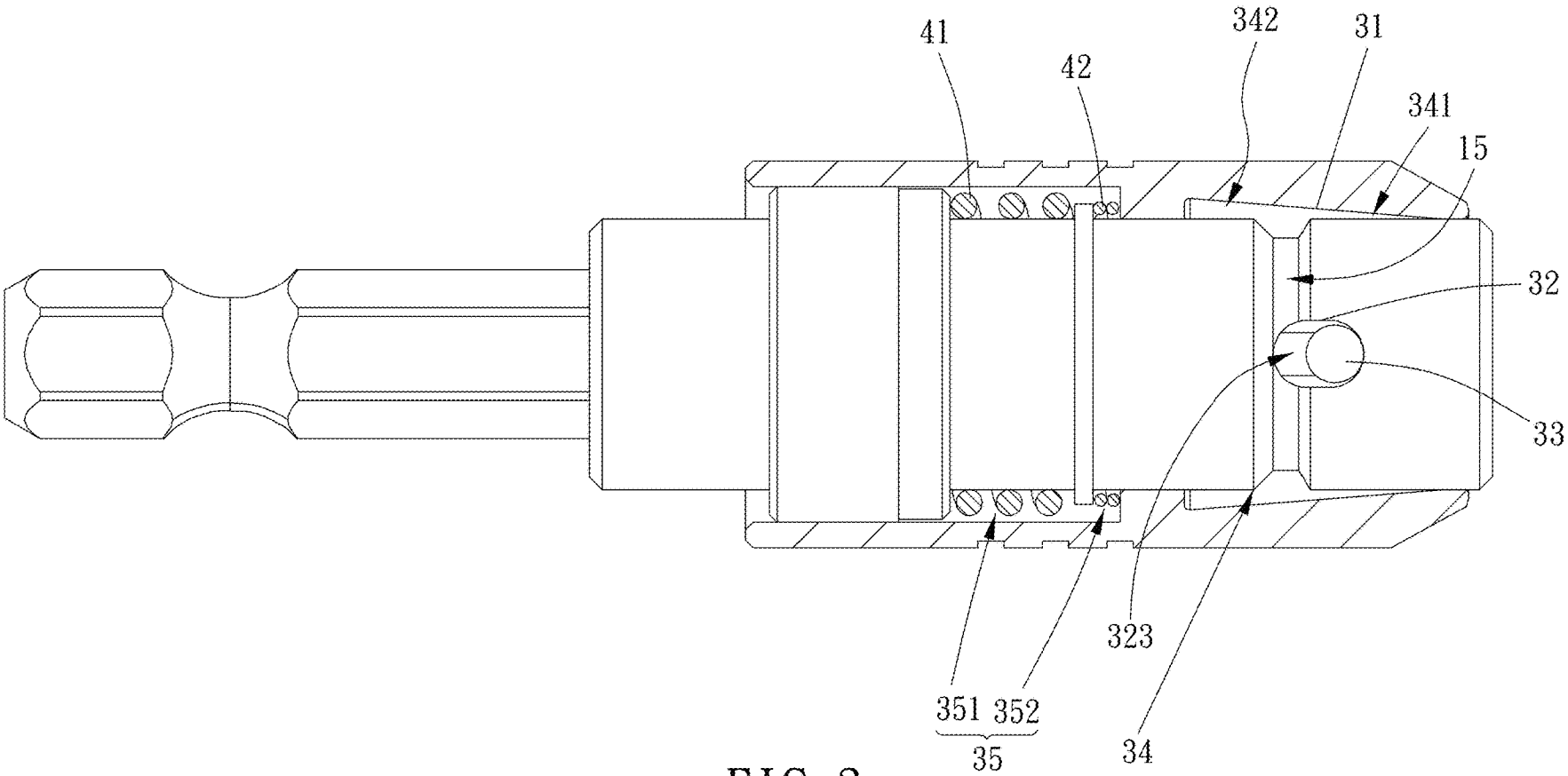
FIG. 3 is a partially cross-sectional view of FIG. 1.
Figure 4:
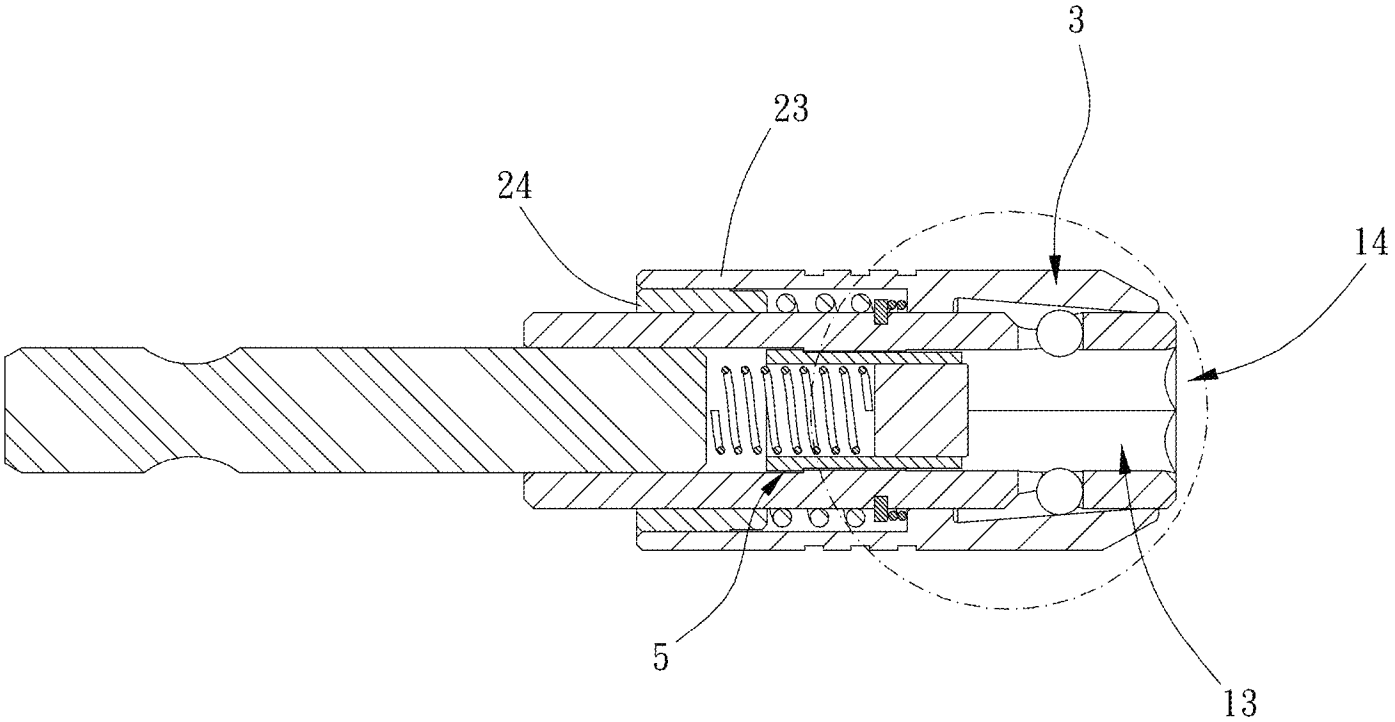
FIG. 4 is a cross-sectional view of FIG. 1
Figure 5:
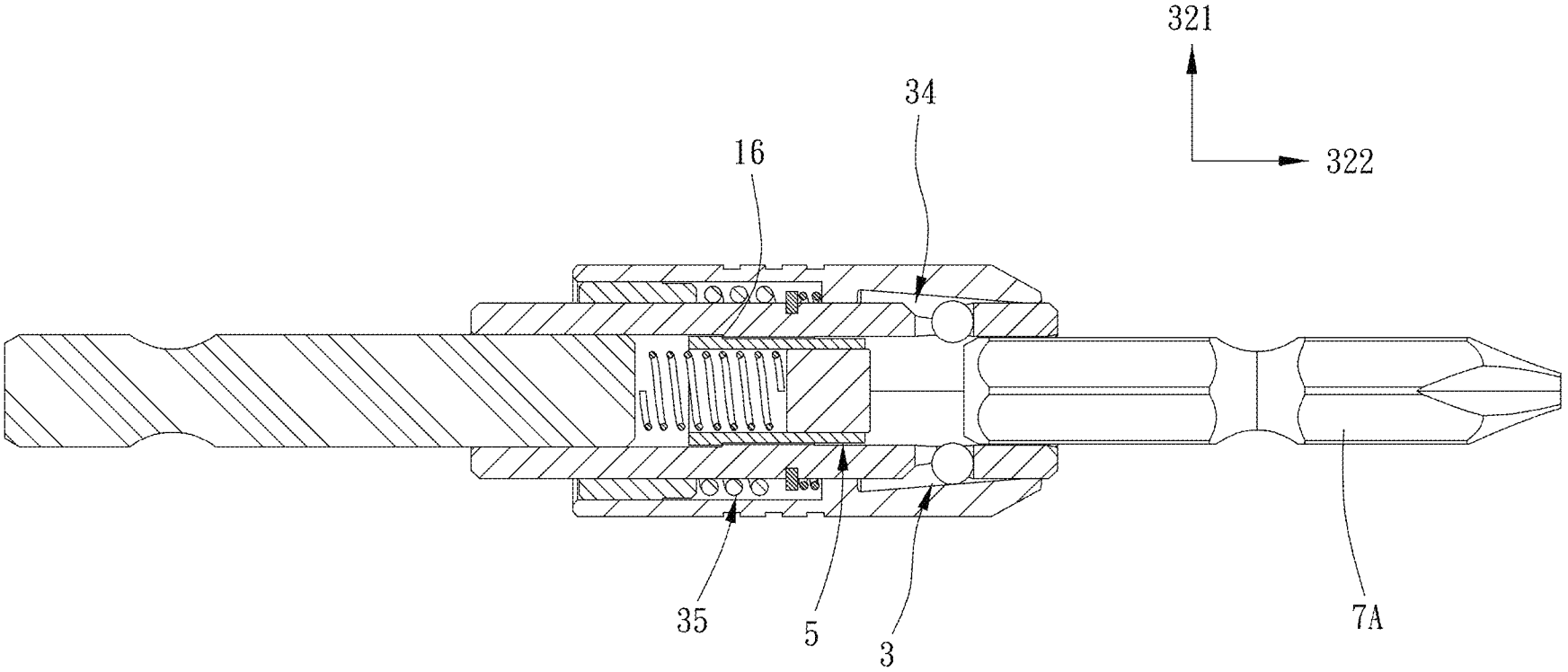
FIGS. 5 and 6 are drawings showing a driving head being inserted of the embodiment of the present invention.
Figure 6:
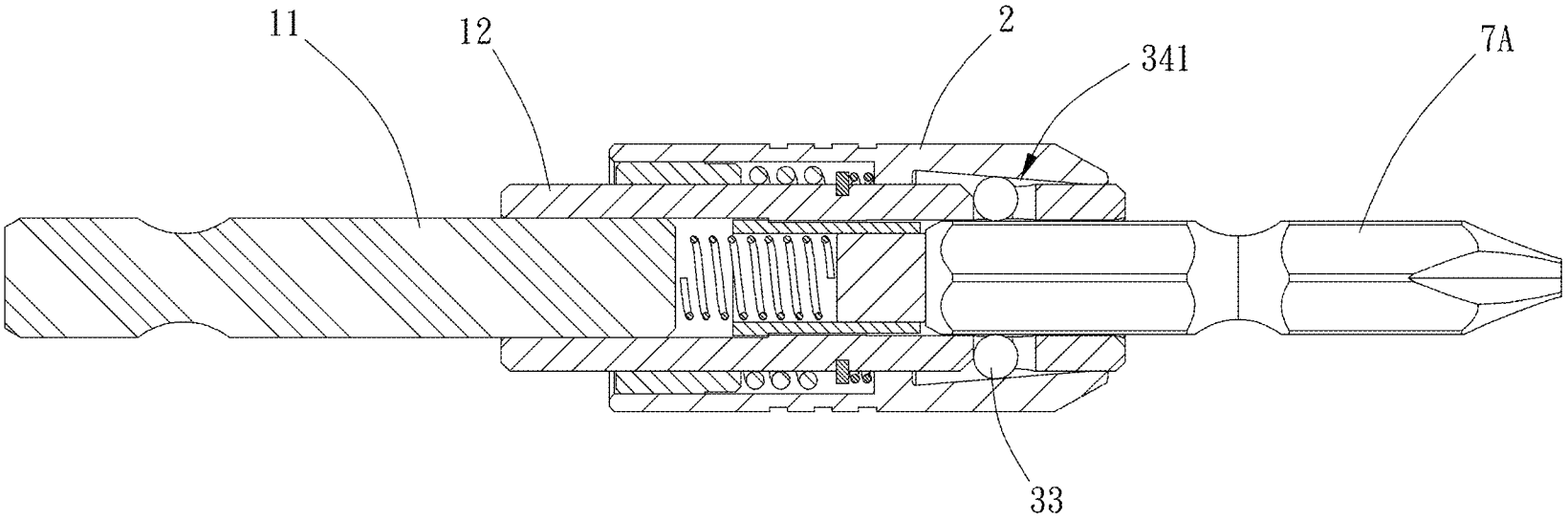
Figure 7:
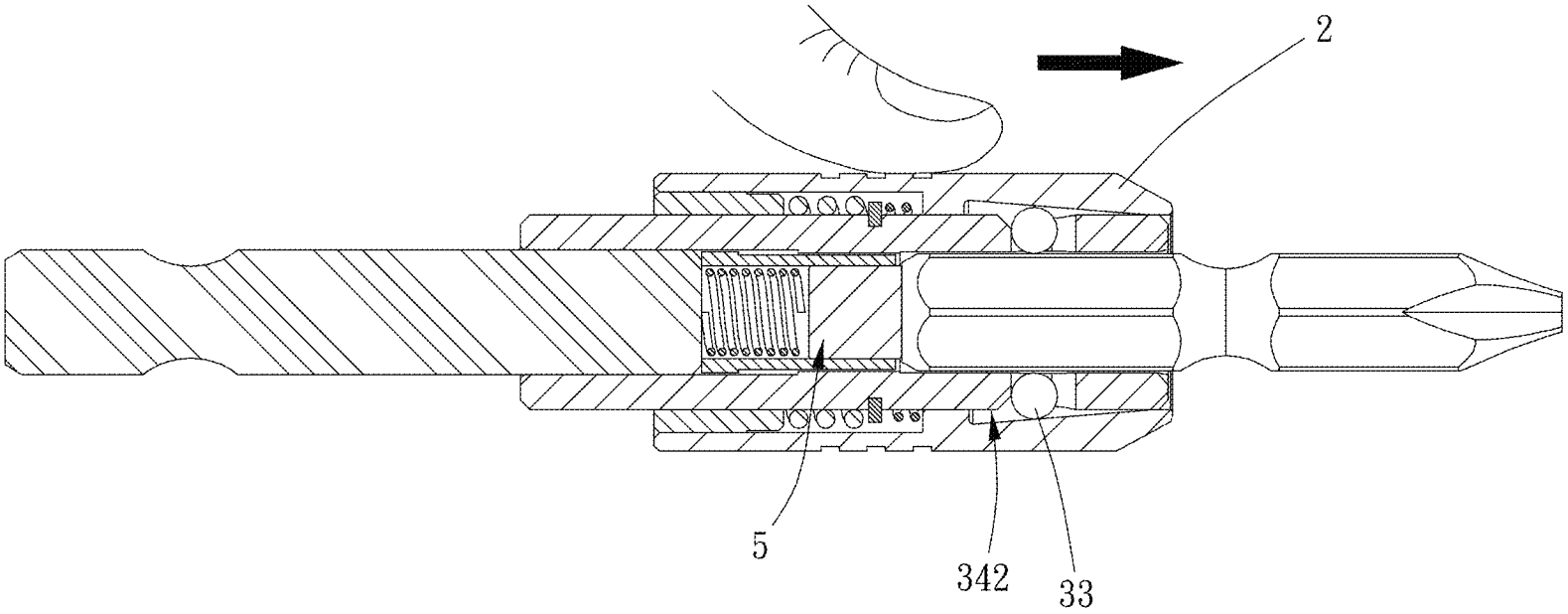
FIG. 7 is a drawing showing the driving head being released of the embodiment of the present invention.
Figure 8:
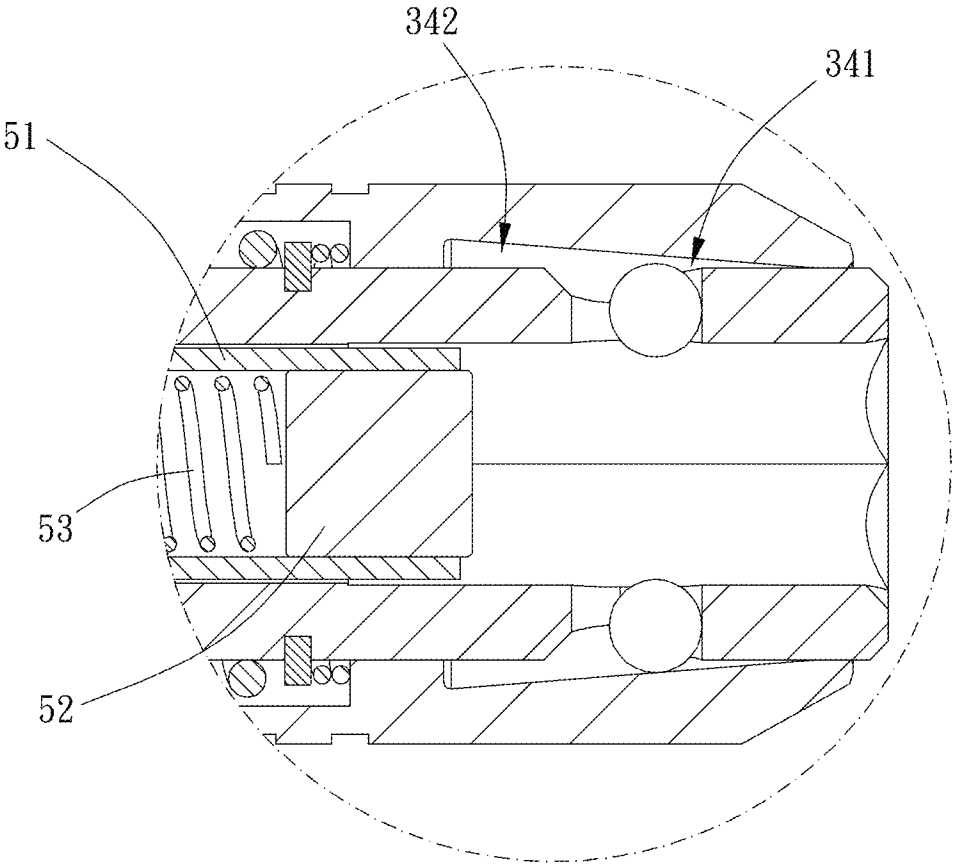
FIG. 8 is a partially enlarged view of FIG. 4.

The present invention will be clearer from the following description when viewed together with the accompanying drawings, which show, for purpose of illustrations only, the preferred embodiment in accordance with the present invention.

Please refer to FIGS. 1 to 10 for an embodiment. A quick-release tool connection rod includes a main member 1, a sleeve 2 and at least one locking mechanism 3.

The main member 1 includes a connecting rod 11 and a working socket 12 which are connected to each other, the connecting rod 11 is configured to be assembled to a power tool 6, the working socket 12 includes an interior space 13 and an insertion opening 14 which communicate with each other, and the insertion opening 14 is configured for a driving member 7A (for example, a screwdriver bit) to be inserted into the interior space 13. The sleeve 2 is movably sleeved on the working socket 12, the sleeve 2 includes an interior wall face 21 and an exterior wall face 22, the interior wall face 21 faces the main member 1, and the exterior wall face 22 is opposite to the main member 1.

There are two of the at least one locking mechanism 3, each said locking mechanism 3 includes a skew guide face 31, an elongate hole 32 and a locking ball 33, the elongate hole 32 is disposed through the working socket 12, the elongate hole 32 defines an open direction 321 and an extension direction 322 which are perpendicular to each other, the skew guide face 31 is recessed on the interior wall face 21 and faces the elongate hole 32, the skew guide face 31 and the working socket 12 define a first receiving space 34, the first receiving space 34 communicates with the interior space 13 through the elongate hole 32, the first receiving space 34 defines a tightening end 341 and a loosening end 342 on the extension direction 322, the skew guide face 31 is gradually distant radially from the working socket 12 in a direction from the tightening end 341 toward the loosening end 342, and the locking ball 33 moves along the extension direction 322 and is movably positioned within the elongate hole 32 along the open direction 321.

Figure 9:
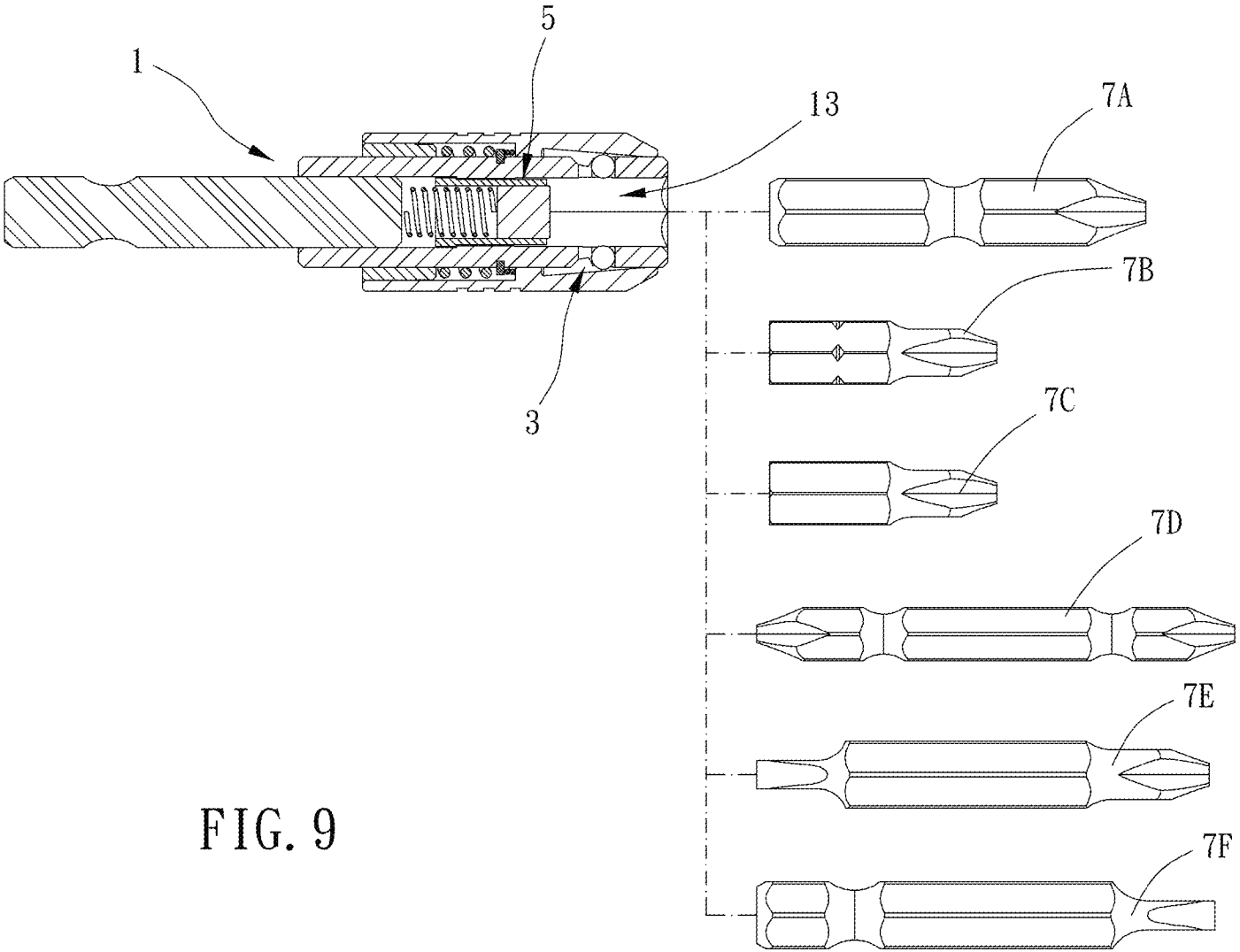
FIG. 9 is a drawing showing multiple models of driving heads being assembled of the embodiment of the present invention.
Figure 10:
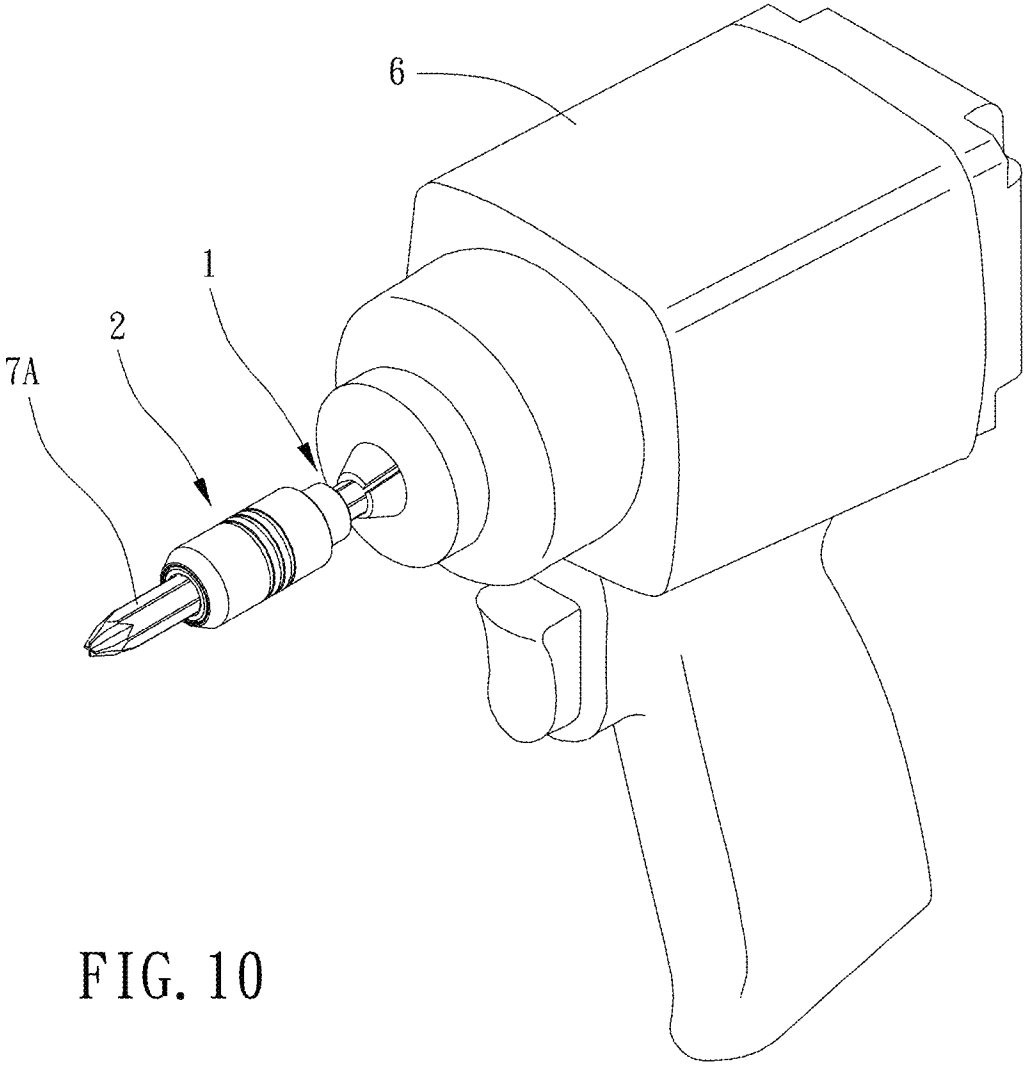
FIG. 10 is a drawing showing an operation of the embodiment of the present invention.

When the sleeve 2 moves from a released position to a locked position, the tightening end 341 is close to the locking ball 33, a spatial allowance of the first receiving space 34 on the opening direction 321 decreases, the skew guide face 31 biases a part of the locking ball 33 to enter the interior space 13, the skew guide face 31 steplessly and continuously biases the locking ball 33 on the opening direction 321 to change a depth of the locking ball 33 into the interior space 13, so as to position the driving member 7A in different dimensions or other driving members 7B, 7C, 7D, 7E, 7F in other models shown in FIG. 9.

Please refer to FIG. 9, when outer surfaces of the driving members 7A, 7C, 7E are planes, the skew guide face 31 allows the locking ball 33 to be slightly into the interior space 13, and the locking ball 33 clips and locks the driving members 7A, 7C, 7E; when the driving members 7B, 7D, 7F shown in FIG. 9 respectively have an engaging groove or a necking section, the skew guide face 31 further pushes the locking ball 33 into the engaging grooves or the necking sections of the driving members 7B, 7D, 7F to interfere and block the driving members 7B, 7D, 7F from moving.

When the sleeve 2 moves from the locked position to the released position, the loosening end 342 is close to the locking ball 33, the spatial allowance of the first receiving space 34 on the opening direction 321 increases, and a part of the locking ball 33 gradually enters the first receiving space 34 and retreats from the interior space 13. A first elastic member 41 is connected to and between the sleeve 2 and the working socket 12, the first elastic member 41 is configured to drive the sleeve 2 to move toward the locked position normally to ensure to stably press the locking ball 33, and when the driving member 7A is inserted into the working socket 12, the sleeve 2 can be stably kept in the locked position.

The locking ball 33 is slidable within the elongate hole 32 along the extension direction 322, the locking ball 33 can randomly bias different positions of a surface of the driving member 7A, and when there are errors of a dimension of the driving member 7A or a dimension of the working socket 12, the locking ball 33 can position the driving member 7A. During a process of the driving member 7A being inserted into the interior space 13, and the locking ball 33 may be pushed by the driving member 7A and moves toward the loosening end 342 to effectively decrease a resistance that the driving member 7A received during the insertion process. With the cooperation of the elongate hole 32 and the skew guide face 31, the driving members 7A, 7B, 7C, 7D, 7E, 7F shown in FIG. 9 are allowed to be inserted into the interior space 13.

Preferably, on the extension direction 322, the skew guide face is greater than the elongate hole 32 in length to provide the first receiving space 34 with various spatial allowances. On the extension direction 322, a ratio between the length of the elongate hole 32 and the length of the skew guide face 31 is preferably between 0.2 and 0.4.

More preferably, when an included angle between the skew guide face 31 and the extension direction 322 is between 3 and 8 degrees, the locking ball 33 can broadly position the driving members 7A, 7B, 7C, 7D, 7E, 7F in different models. Even more preferably, an adjustment groove 15 is recessed on the working socket 12, the adjustment groove 15 is laterally communicable with an adjusting end 323 of the elongate hole 32, and the adjusting end 323 is closer to the loosening end 342 to further adjust a length of the elongate hole 32 or bias the locking ball 33 to lock the driving member 7A more firmly.

The sleeve 2 and the working socket 12 define a second receiving space 35, a protrusion 36 is positioned on the working socket 12 and within the second receiving space 35, the protrusion 36 divides the second receiving space 35 into a first section 351 and a second section 352, and the first elastic member 41 is received in the first section 351 and respectively connected to the protrusion 36 and the sleeve 2. A second elastic member 42 is received in the second section 352 and respectively connected to the protrusion 36 and the sleeve 2, and the second elastic 42 is configured to bias the sleeve 2 to have a tendency to move toward the released position; wherein the first elastic member 41 is greater than the second elastic member 42 in flexibility.

The first elastic member 41 provides a locking force to the sleeve 2, the second elastic member 42 provides a releasing force to sleeve 2, and the second elastic member 42 can slightly adjust the locking force, and a user can easily push the sleeve 2 to the released position.

In this embodiment, the protrusion 36 is an E-type buckle, the protrusion 36 is positioned on the working socket 12 through engagement. In addition, the sleeve 2 includes a main body 23 and a stopper 24, the skew guide face 31 is recessed on a head end 231 of the main body 23, on a radial direction of the working socket 12, a bottom end 232 of the main body 23 has an opening and spacingly arranged relative to the working socket 12, the stopper 24 seals the opening of the bottom end 232 and is disposed in the main body 23, the first elastic member 41 is abutted against and between the protrusion 36 and the stopper 24, and the second elastic member 42 is abutted against and between the protrusion 36 and the main body 23.

The sleeve 2 is movable on an axial direction of the working socket 12, the extension direction 322 of the elongate hole 32 defines the axial direction of the working socket 12, the open direction 321 of the elongate hole 32 is a radial direction of the working socket 12, and the tightening end 341 is closer to the insertion opening 14 than the loosening end 342 to actuate the sleeve 2 toward the insertion opening 14 to release.

Preferably, an exterior wall face 22 of the sleeve 2 has an anti-slip structure 25, and the anti-slip structure 25 is for a hand to press thereon for the user to stably and quickly actuate the sleeve 2.

The quick-release tool connection rod further includes a magnetic assembly 5, the magnetic assembly 5 is received in the interior space 13, the magnetic assembly 5 includes a base 51, a magnet 52 and a third elastic member 53, the third elastic member 53 is respectively connected to the main member 1 and the base 51, and the magnet 52 is received in the base 51 for magnetically attracting the driving member 7A to increase the stability of the driving member 7A additionally. When the sleeve 2 moves to the released position, the magnet 52 can magnetically attract the driving member 7A to prevent the driving member 7A from falling off.

In this embodiment, the working socket 12 further includes a first stepped portion 16, the first stepped portion 16 protrudes into the interior space 13, the base 15 is cylindrical, the base 51 includes a radially narrower segment 511 and a radially wider segment 512, the radially narrower segment 511 and the radially wider segment 512 are connected to each other to form a second stepped portion 513, and the second stepped portion 513 faces the insertion opening 14 to optionally abut against the first stepped portion 16 to restrict a position of the magnet 52 and prevent the magnet 52 from falling out of the insertion opening 14.

While we have shown and described various embodiments in accordance with the present invention, it should be clear to those skilled in the art that further embodiments may be made without departing from the scope of the present invention.

What is claimed is:

1. A quick-release tool connection rod, including:

a main member, including a connecting rod and a working socket which are connected to each other, the connecting rod being configured to be assembled to a power tool, the working socket including an interior space and an insertion opening which communicate with each other, the insertion opening being configured for a driving member to be inserted into the interior space;

a sleeve, movably sleeved on the working socket, the sleeve including an interior wall face and an exterior wall face, the interior wall face facing the main member, the exterior wall face facing away from the main member;

at least one locking mechanism, each said locking mechanism including a skew guide face, an elongate hole and a locking ball, the elongate hole being disposed through the working socket, the elongate hole defining an open direction and an extension direction which are perpendicular to each other, the skew guide face being recessed on the interior wall face and facing the elongate hole, the skew guide face and the working socket defining a first receiving space, the first receiving space communicating with the interior space through the elongate hole, the first receiving space defining a tightening end and a loosening end on the extension direction, the skew guide face being gradually distant radially from the working socket in a direction from the tightening end toward the loosening end, the locking ball moving along the extension direction and movably positioned within the elongate hole along the open direction;

wherein when the sleeve moves from a released position to a locked position, the tightening end moves toward the locking ball, the skew guide face biases a part of the locking ball to enter the interior space, and when the sleeve moves from the locked position to the released position, the loosening end moves toward the locking ball, and a part of the locking ball gradually enters the first receiving space and retreats from the interior space; wherein a first elastic member is connected to and between the sleeve and the working socket, and the first elastic member is configured to drive the sleeve to move toward the locked position normally;

wherein the sleeve and the working socket define a second receiving space, a protrusion is positioned on the working socket and within the second receiving space, the protrusion divides the second receiving space into a first section and a second section, the first elastic member is received in the first section and respectively connected to the protrusion and the sleeve, a second elastic member is received in the second section and respectively connected to the protrusion and the sleeve, and the second elastic is configured to bias the sleeve to have a tendency to move toward the released position; wherein the first elastic member is greater than the second elastic member in flexibility.

2. The quick-release tool connection rod of claim 1, further including a magnetic assembly, the magnetic assembly being received in the interior space, the magnetic assembly including a base, a magnet and a third elastic member, the third elastic member being respectively connected to the main member and the base, the magnet being received in the base for magnetically attracting the driving member.

3. The quick-release tool connection rod of claim 1, wherein an adjustment groove is recessed on the working socket, the adjustment groove is laterally communicable with an adjusting end of the elongate hole, and the adjusting end is closer to the loosening end than to the tightening end.

4. The quick-release tool connection rod of claim 1, wherein the exterior wall face of the sleeve has an anti-slip structure, and the anti-slip structure is for a hand to press thereon.

5. The quick-release tool connection rod of claim 1, wherein the sleeve is movable on an axial direction of the working socket, the extension direction of the elongate hole defines the axial direction of the working socket, the open direction of the elongate hole is a radial direction of the working socket, and the tightening end is closer to the insertion opening than the loosening end.

6. The quick-release tool connection rod of claim 5, wherein on the extension direction, the skew guide face is greater than the elongate hole in length.

7. The quick-release tool connection rod of claim 5, wherein an included angle between the skew guide face and the extension direction is between 3 and 8 degrees.

* * * * *